US011045671B2

(12) United States Patent
Saggio

(10) Patent No.: US 11,045,671 B2
(45) Date of Patent: Jun. 29, 2021

(54) BACK SUPPORT FRAME

(71) Applicant: Unprecedented Concepts, LLC, Glendale, AZ (US)

(72) Inventor: Thomas Saggio, Glendale, AZ (US)

(73) Assignee: Unprecedented Concepts LLC, Glendale, AZ (US)

( * ) Notice: Subject to any disclaimer, the term of this patent is extended or adjusted under 35 U.S.C. 154(b) by 0 days.

(21) Appl. No.: 16/295,178

(22) Filed: Mar. 7, 2019

(65) Prior Publication Data

US 2019/0282840 A1 Sep. 19, 2019

Related U.S. Application Data

(60) Provisional application No. 62/642,469, filed on Mar. 13, 2018.

(51) Int. Cl.

| | |
|---|---|
| ***A62B 9/04*** | (2006.01) |
| ***A62B 25/00*** | (2006.01) |
| *A45F 3/10* | (2006.01) |

(52) U.S. Cl.

CPC ..... *A62B 9/04* (2013.01); *A62B 25/00* (2013.01); *A45F 3/10* (2013.01)

(58) Field of Classification Search

CPC ..... A62B 9/04; A62B 25/00; B63C 2011/026; A45F 3/10; A45F 3/08; A45F 3/06; A45F 2003/003; A41D 13/0531

(Continued)

(56) References Cited

U.S. PATENT DOCUMENTS

| | | | |
|---|---|---|---|
| 1,448,918 | A | 6/1921 | Drager |
| 1,589,463 | A | 8/1923 | Drager |

(Continued)

FOREIGN PATENT DOCUMENTS

| | | | |
|---|---|---|---|
| DE | 403600 | 10/1924 | |
| FR | 2818510 A1 * | 6/2002 | ..... A45F 3/04 |

(Continued)

OTHER PUBLICATIONS

Schmitz@Fenan "Oxygen positive pressure self contained breathing apparatus, 200bar portable closed circuit SCBA for firefighting, mining," https://fenan-china.en.alibaba.com/product/60319228664-801763150/ Oxygen_positive_pressure_self_contained_breathing_apparatus_200bar_portable_closed_circuit_SCBA for_firefighting_mining.html, accessed Apr. 2, 2019.

*Primary Examiner* — Scott T McNurlen

(74) *Attorney, Agent, or Firm* — The Noblitt Group, PLLC

(57) ABSTRACT

An SCBA frame for mounting self-contained breathing apparatus bottles horizontally such that the frame can articulate with the back of a user, comprising an upper plate, intermediate plate and a lower plate each connected by attachment mechanisms. Each of the plates may comprise a top edge, a bottom edge, and a pair of sides. A first attachment mechanism coupled to the bottom edge of the upper plate and a top edge of the intermediate plate and a second attachment mechanism coupled to the bottom edge of the intermediate plate and the top edge of the lower plate. The first and second attachment mechanisms allow the upper plate, intermediate plate, and lower plate to move about the horizontal axis and torsionally in line with the user's movement. The first and second attachment mechanism comprises a pair of attachment mechanisms located proximate the sides of the upper plate and intermediate plate.

15 Claims, 13 Drawing Sheets

(58) Field of Classification Search
USPC ..... 224/628, 633–634, 26–263, 907
See application file for complete search history.

(56) References Cited

U.S. PATENT DOCUMENTS

| | | | | | |
|---|---|---|---|---|---|
| 2,937,835 | A * | 5/1960 | Csmereka | F16L 3/1091 | 248/74.4 |
| 5,152,441 | A * | 10/1992 | Torena | A45C 15/00 | 206/373 |
| 5,573,136 | A * | 11/1996 | Page | A47G 23/0616 | 220/754 |
| 6,502,732 | B1 * | 1/2003 | Bonds | A45F 3/14 | 224/586 |
| 6,871,368 | B2 * | 3/2005 | Calkin | A61G 1/01 | 5/625 |
| 2009/0229603 | A1 | 9/2009 | Grilliot et al. | | |
| 2009/0249700 | A1 * | 10/2009 | Peterson | A45F 3/08 | 52/2.17 |
| 2013/0105537 | A1 * | 5/2013 | Shalom | A45F 3/04 | 224/628 |
| 2014/0069427 | A1 | 3/2014 | Farnaby et al. | | |
| 2014/0224252 | A1 | 8/2014 | Martin et al. | | |
| 2019/0191794 | A1 * | 6/2019 | Boria | A41D 13/0153 | |

FOREIGN PATENT DOCUMENTS

| | | | |
|---|---|---|---|
| GB | 146838 | A | 6/1921 |
| GB | 215576 | A | 5/1924 |

* cited by examiner

BACK SUPPORT FRAME

CROSS-REFERENCES TO RELATED APPLICATIONS

The present application claims the benefit of U.S. Provisional Application Ser. No. 62/642,469, filed Mar. 13, 2018 and incorporates the disclosure of this application by reference.

BACKGROUND OF THE INVENTION

Self-Contained Breathing Apparatus ("SCBA"), which are utilized in the fire service industry typically consists of one SCBA frame/harness and a generally vertically oriented air bottle that is strapped onto the firefighters back and worn over his/her canvas turnouts. The standard SCBA design is somewhat similar to a standard SCUBA tank design. However, there is an obvious difference in the environment where these frames are used that impact users of the SCBA and the SCUBA frames. For example, while using a SCUBA tank, the human body is buoyant and is not subject to the stresses of gravity outside of water. However, when a firefighter uses a SCBA, the conditions and stresses on the firefighter can cause significant duress and injury.

Consistent use of the standard SCBA configuration can cause significant wear on the users back and spine. Specifically, injuries to the L4-L5 and L5-S1 have been reported with some frequency and can require surgery, which immobilize the firefighter and removes them from service. Presently, the standard SCBA restricts movement along the spine causing the lower back to function as the only hinge and fulcrum for movement, thus placing all the stress of the torso on the lower spine.

As such, an improved SCBA frame may be utilized that reduces injuries to firefighters to increase the quality of life that may be severely limited by the nature of a common injury attributed to firefighters by neuro surgeons and medical doctors. The current SCBA configuration contributes to and causes severe back injuries, L4, L5, S1 herniation's of the spine.

SUMMARY OF THE INVENTION

An exemplary SCBA frame may comprise a frame having more than one plate coupled together via an attachment system. The attachment system allows the plates to move relative to one another. The SCBA frame mimics the shape of the wearer's back. The SCBA frame may be configured to receive more than one air cylinder and the cylinders may be connected by standard hoses. The SCBA frame also may receive a standard SCBA harness, breathing apparatus, and waist attachment.

The SCBA frame for mounting self-contained breathing apparatus bottles horizontally such that the frame can move or articulate with the back of a user. The SCBA frame may comprise an upper plate comprising a top edge, a bottom edge, and a pair of sides; an intermediate plate comprising a top edge, a bottom edge, and a pair of sides; a lower plate comprising a top edge, a bottom edge, and, a pair of side; a first attachment mechanism coupled to the bottom edge of the upper plate and a top edge of the intermediate plate; and a second attachment mechanism coupled to the bottom edge of the intermediate plate and the top edge of the lower plate; wherein the first and second attachment mechanisms allow the upper plate, intermediate plate, and lower plate to move about the horizontal axis and torsionally in line with the user's movement. The first attachment mechanism comprises a pair of attachment mechanisms located proximate the sides of the upper plate and intermediate plate. The frame may comprise first and second attachment mechanisms having a pair of attachment mechanisms are located proximate the sides of the upper plate, intermediate plate, and lower plate.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

Figure 1:
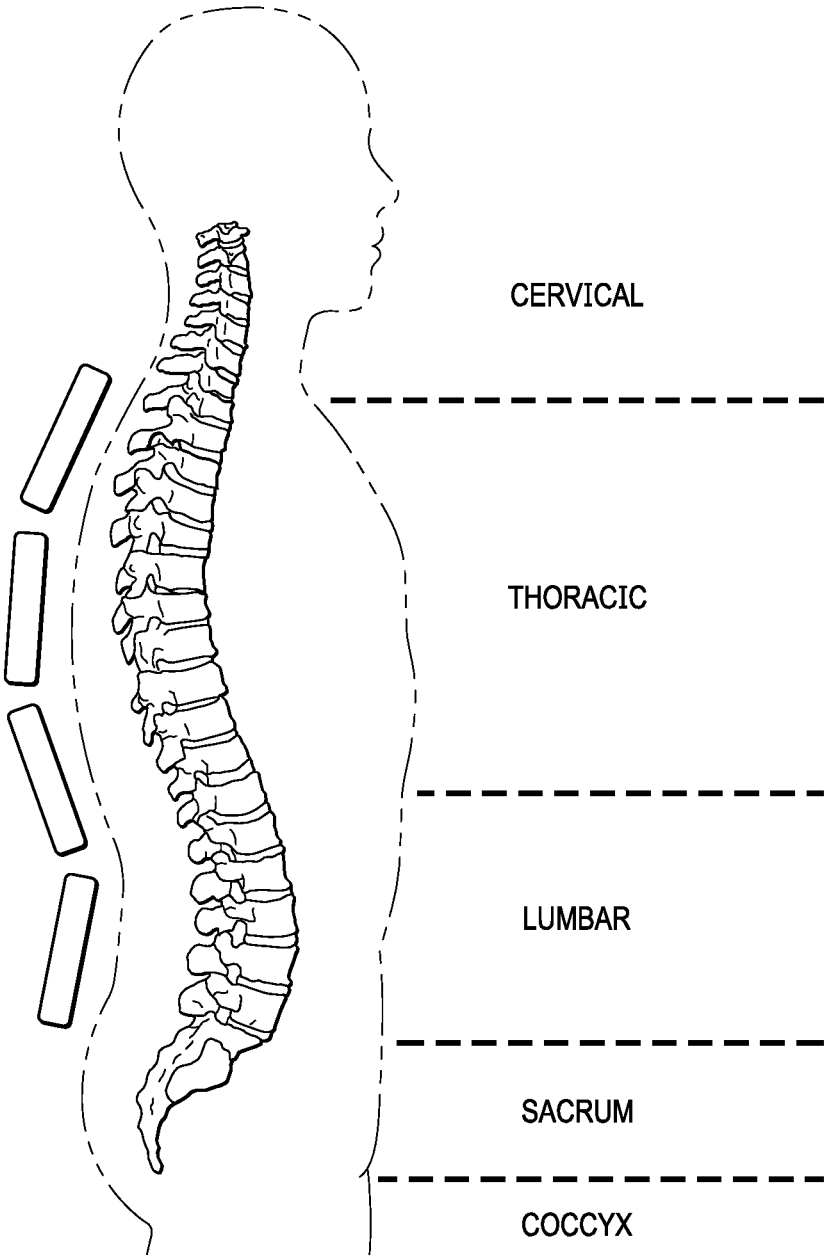
Figure 2:
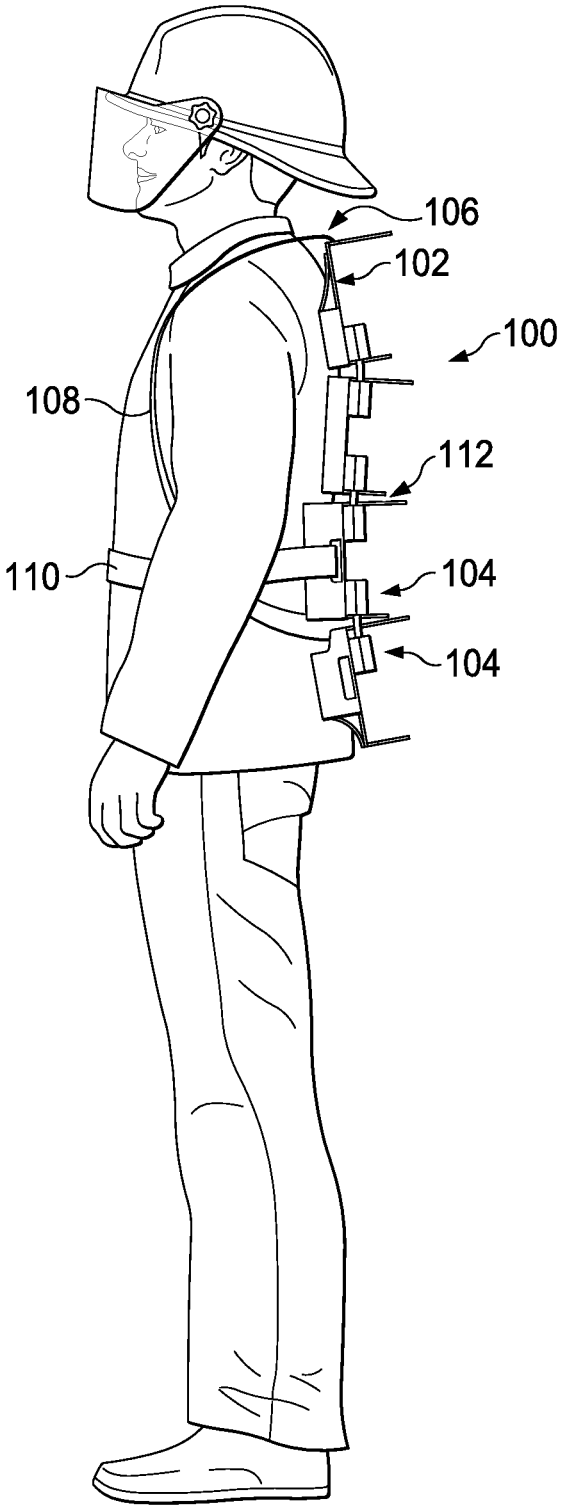
Figure 3:
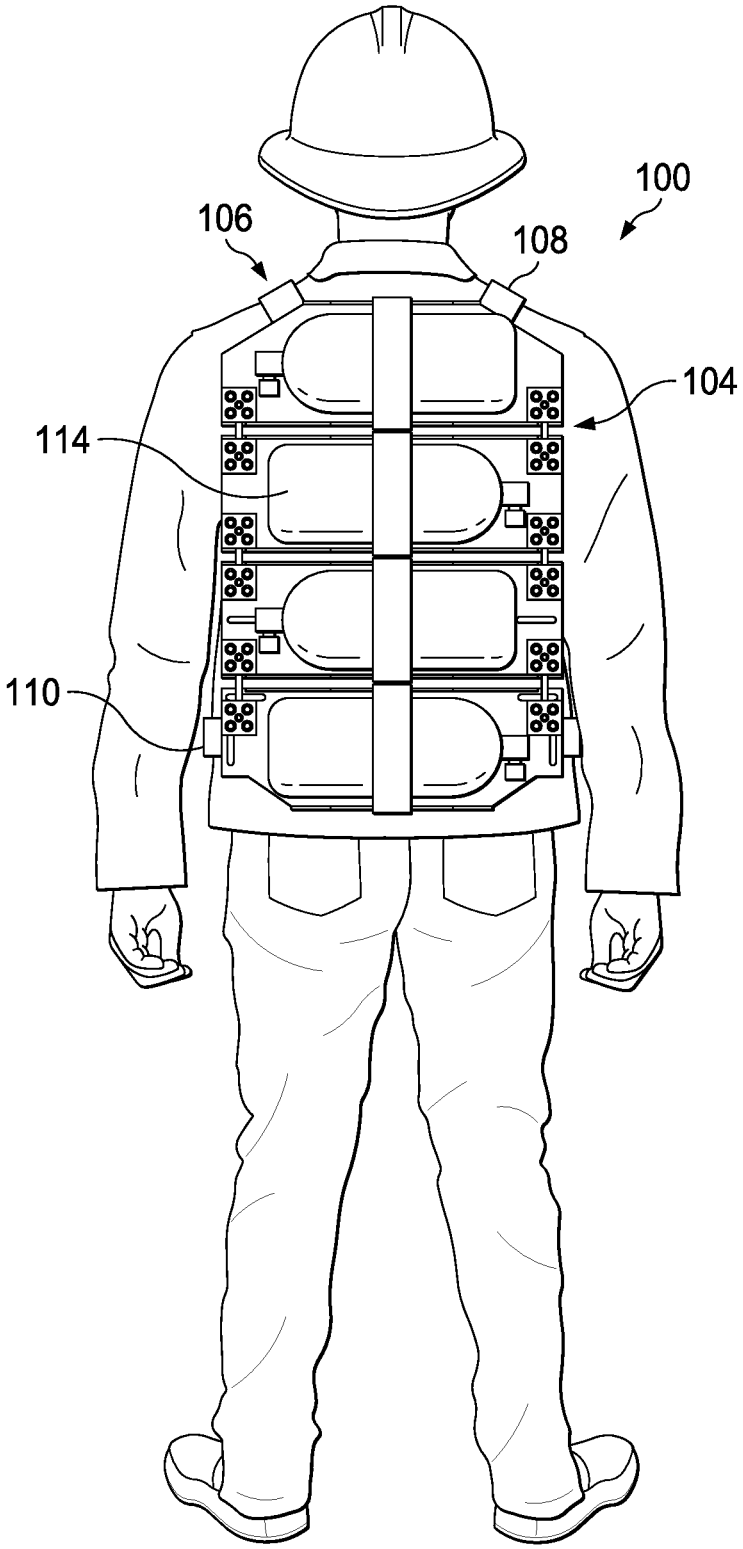
Figure 4:
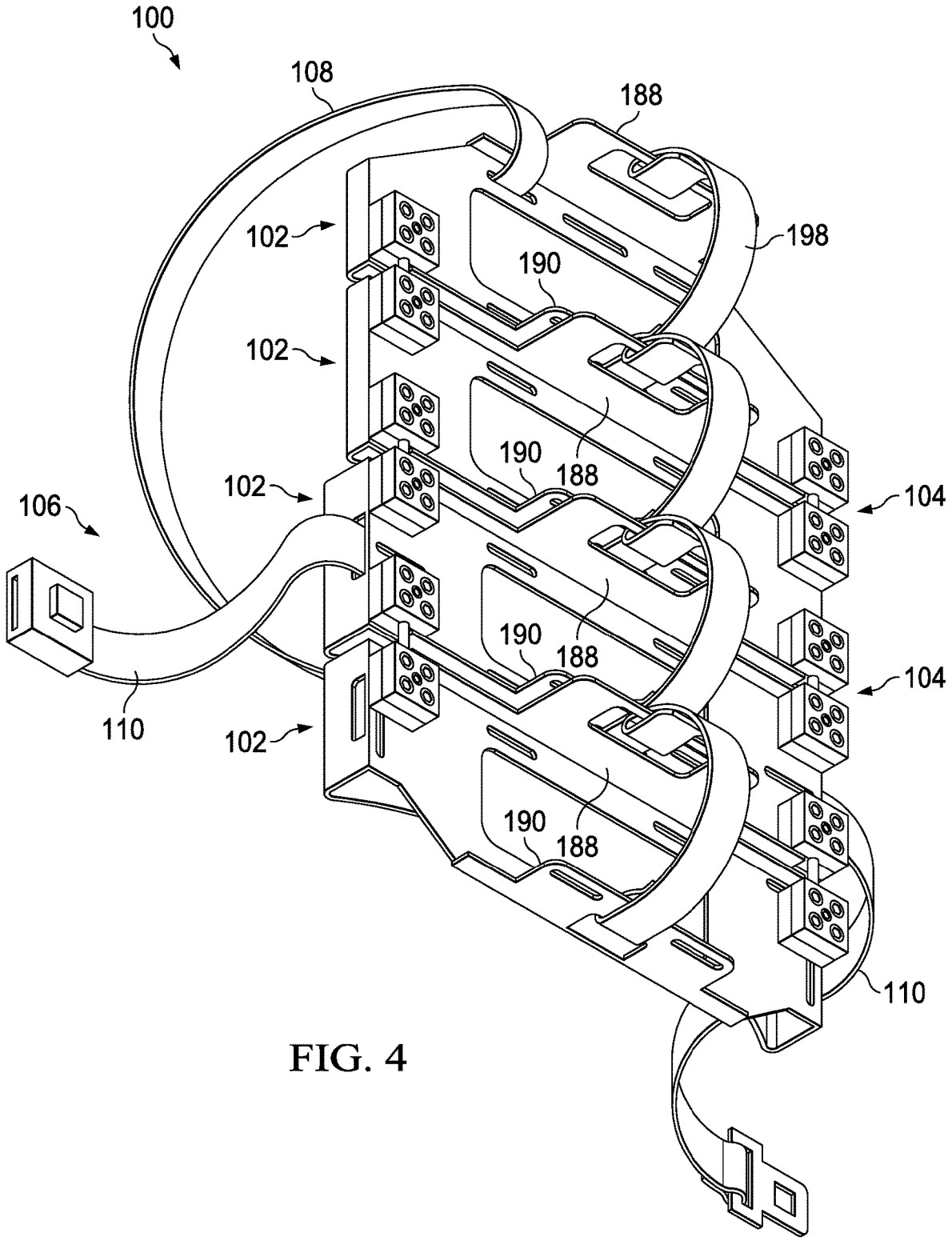
Figure 5A:
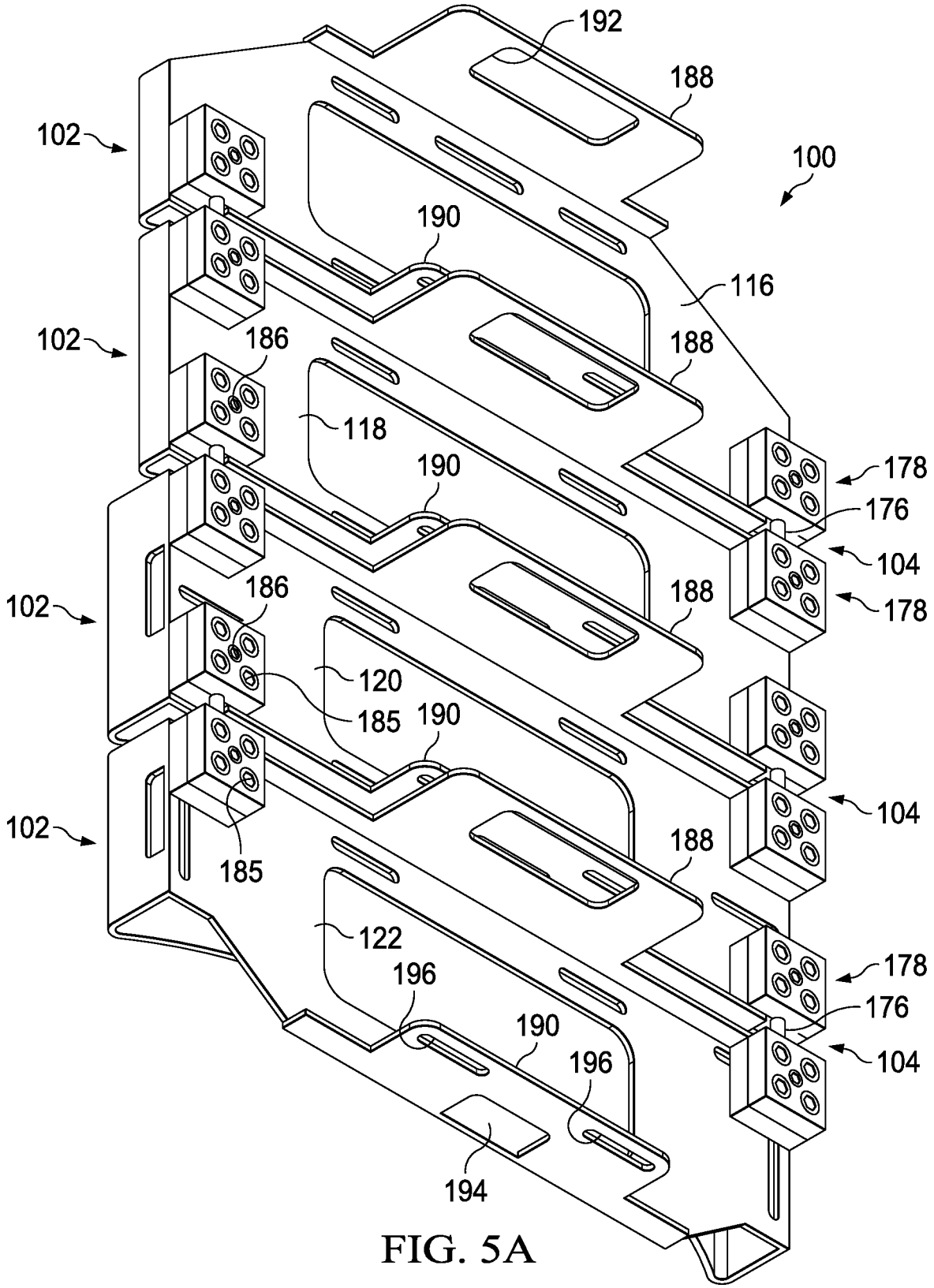
Figure 5B:
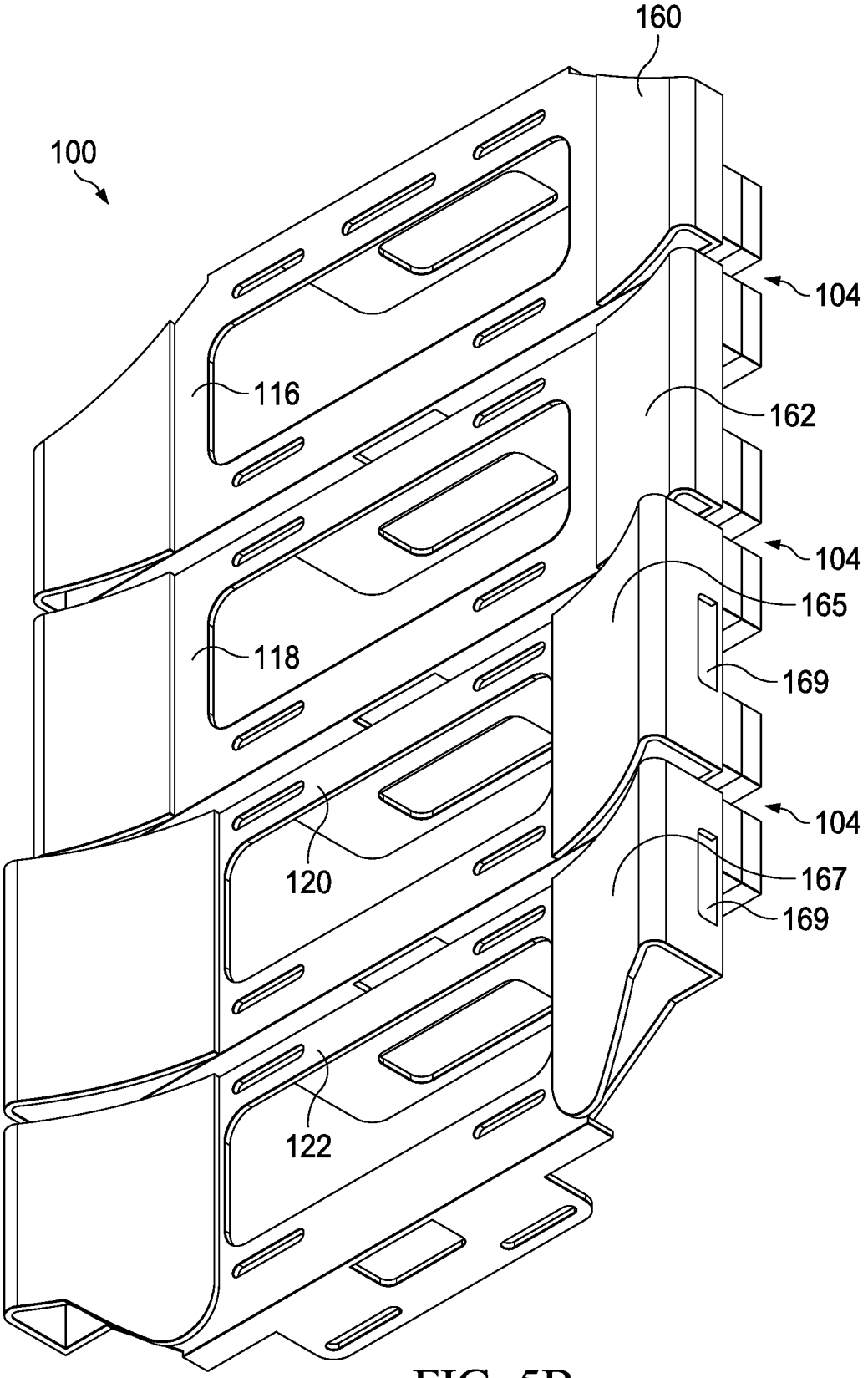
Figure 6A:
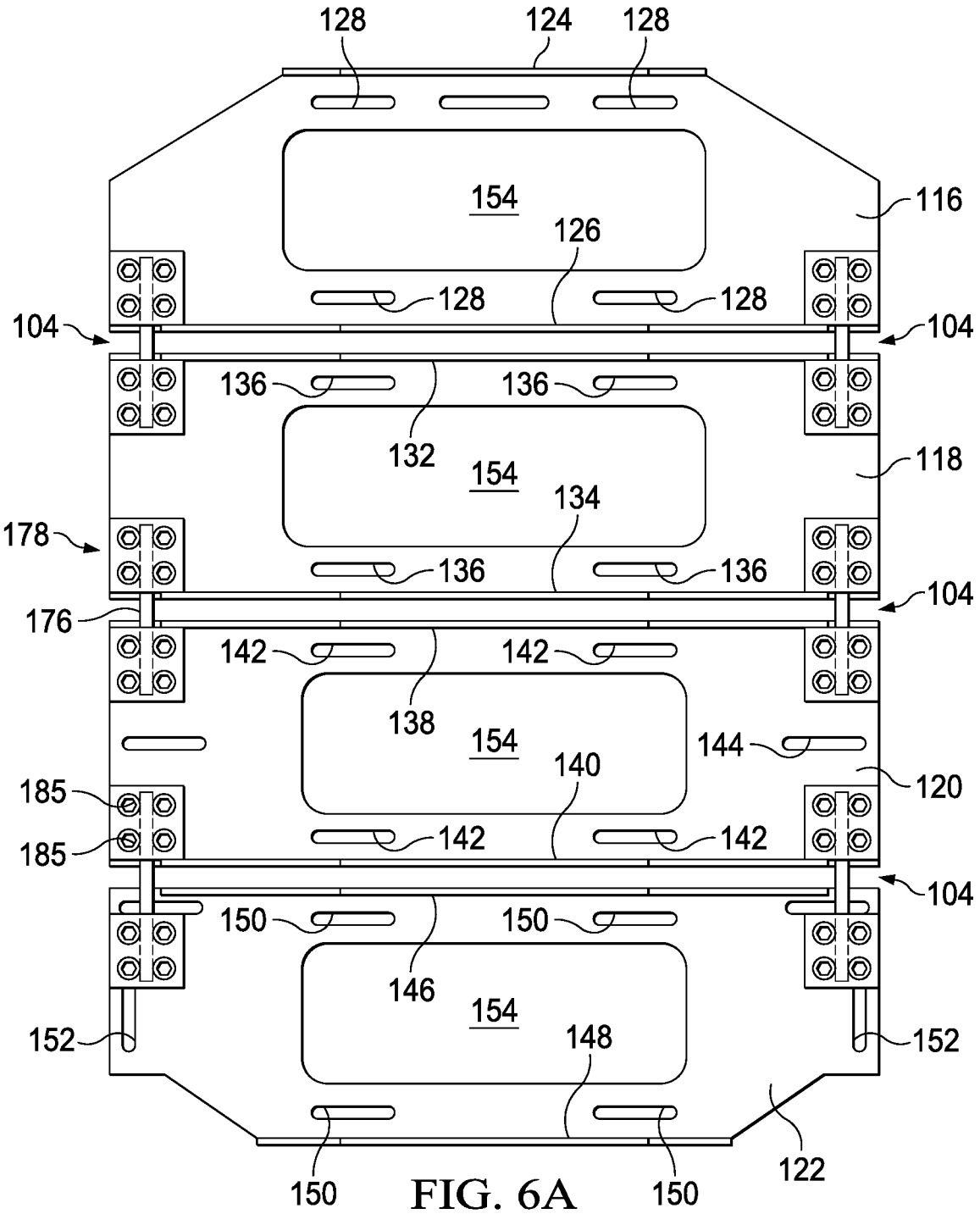
Figure 6B:
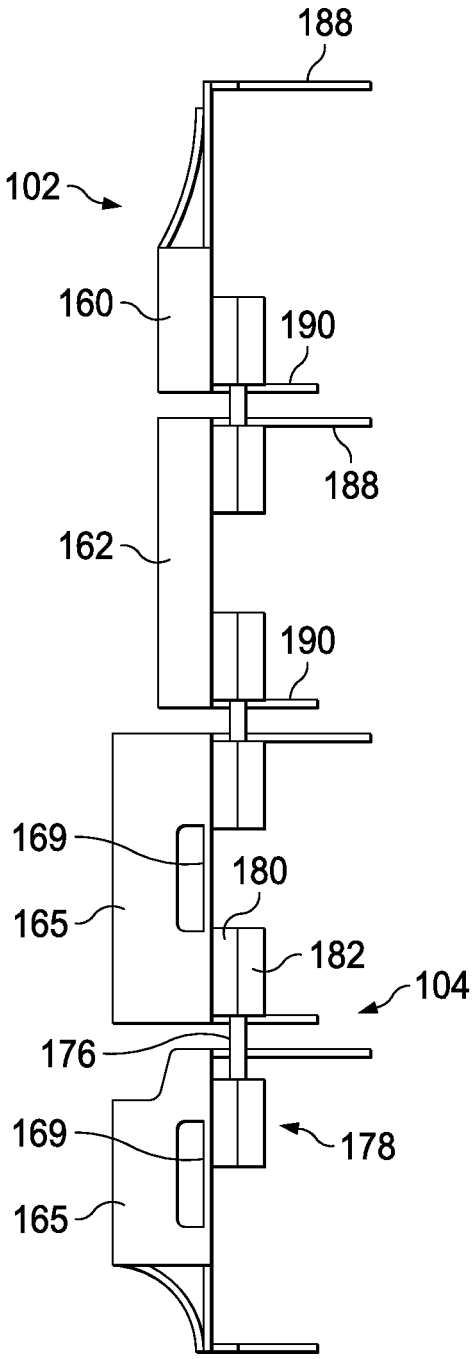
Figure 7A:
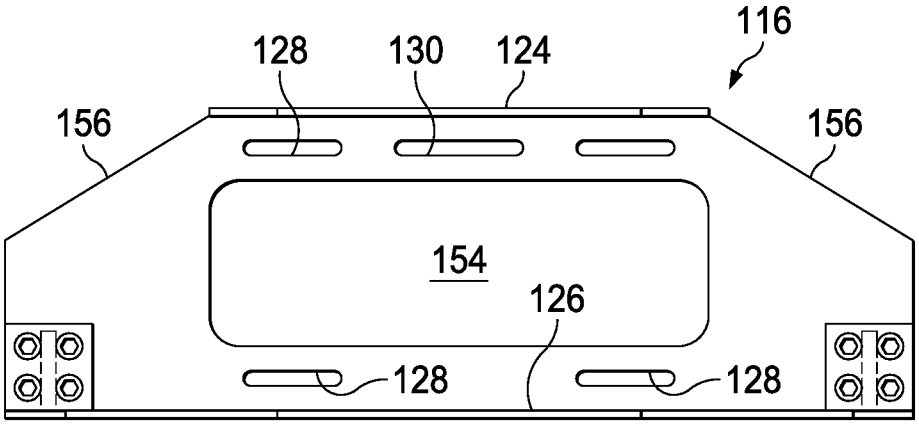
Figure 7B:
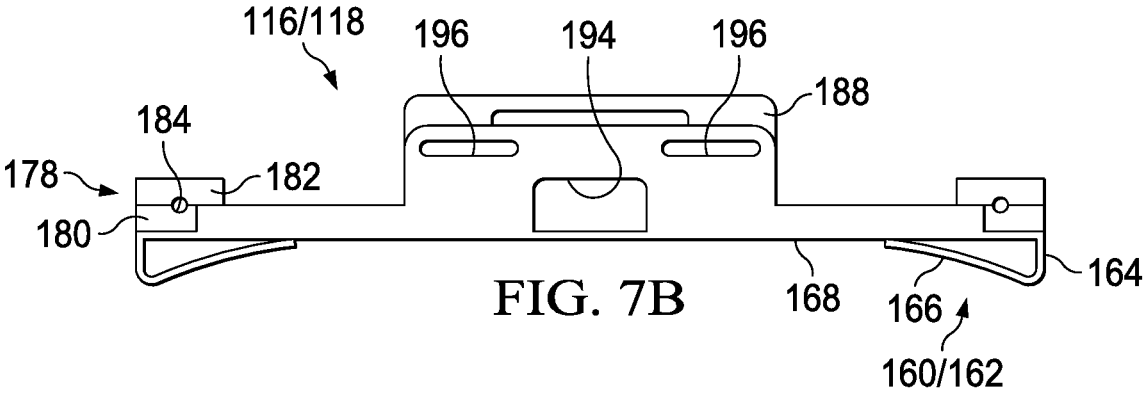
Figure 7C:
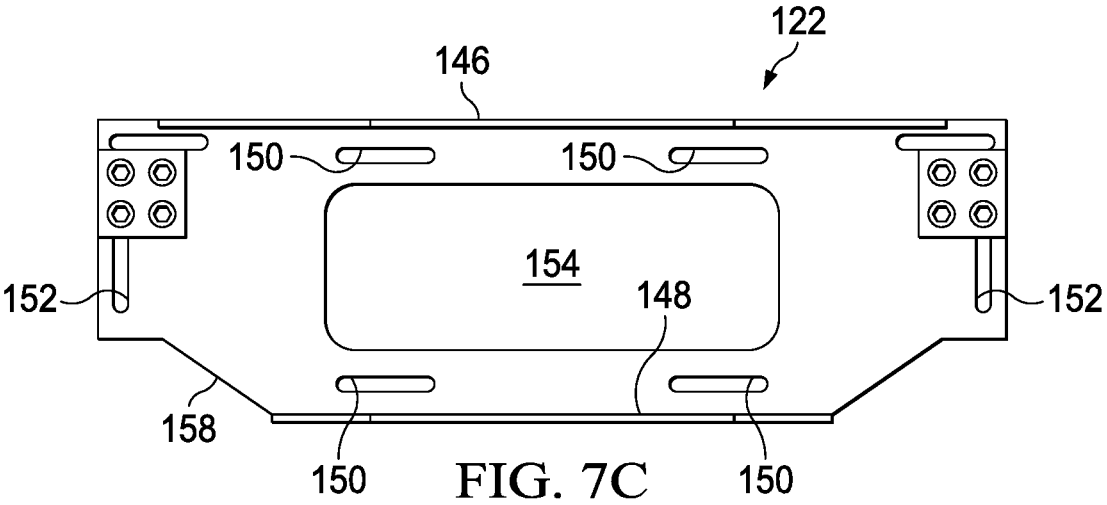
Figure 7D:
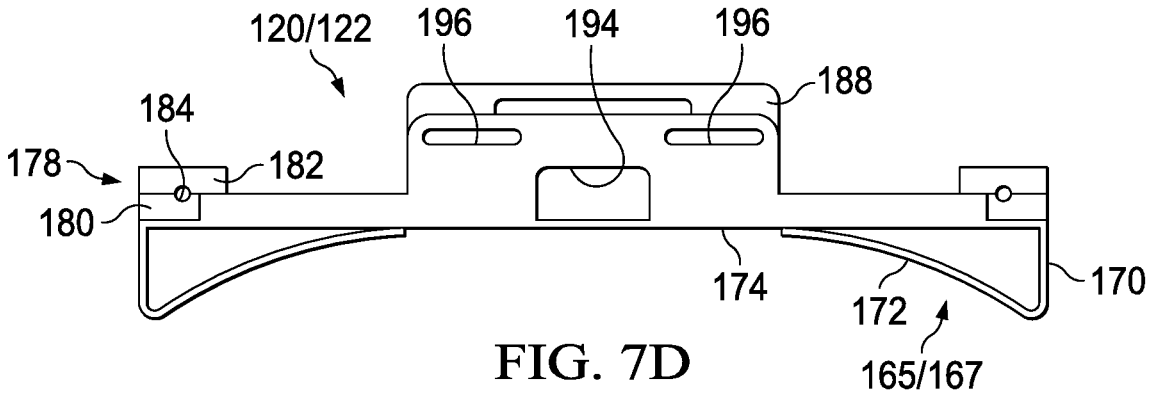
Figure 7E:
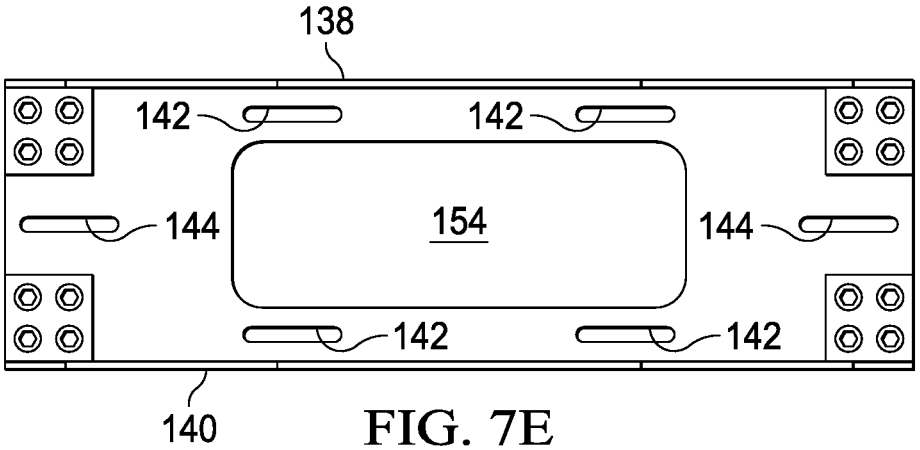
Figure 7F:
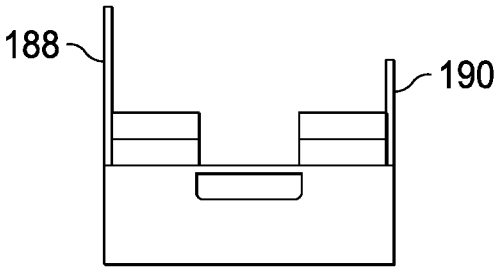
Figure 8A:
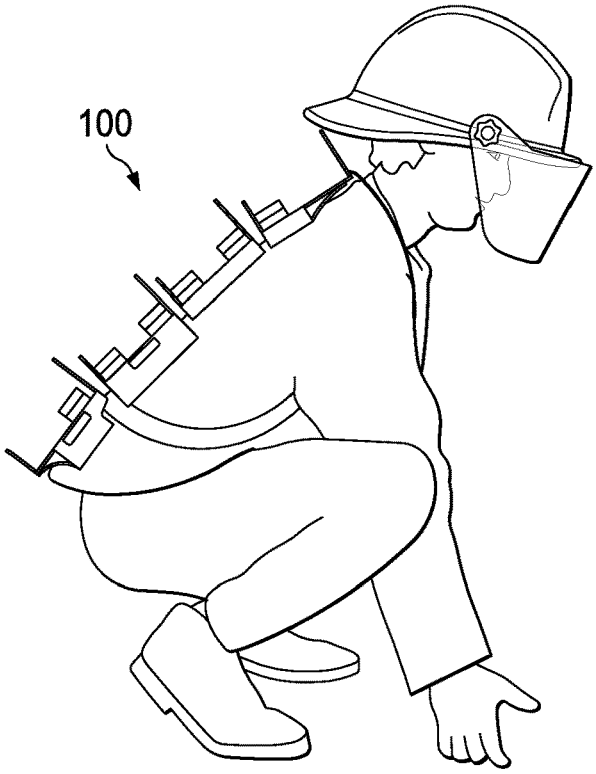
Figure 8B:
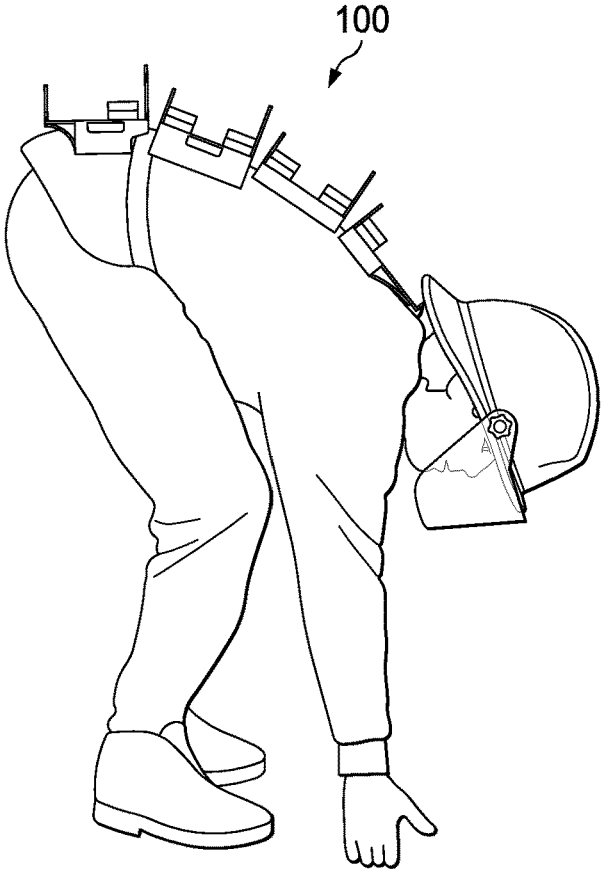
Figure 8C:
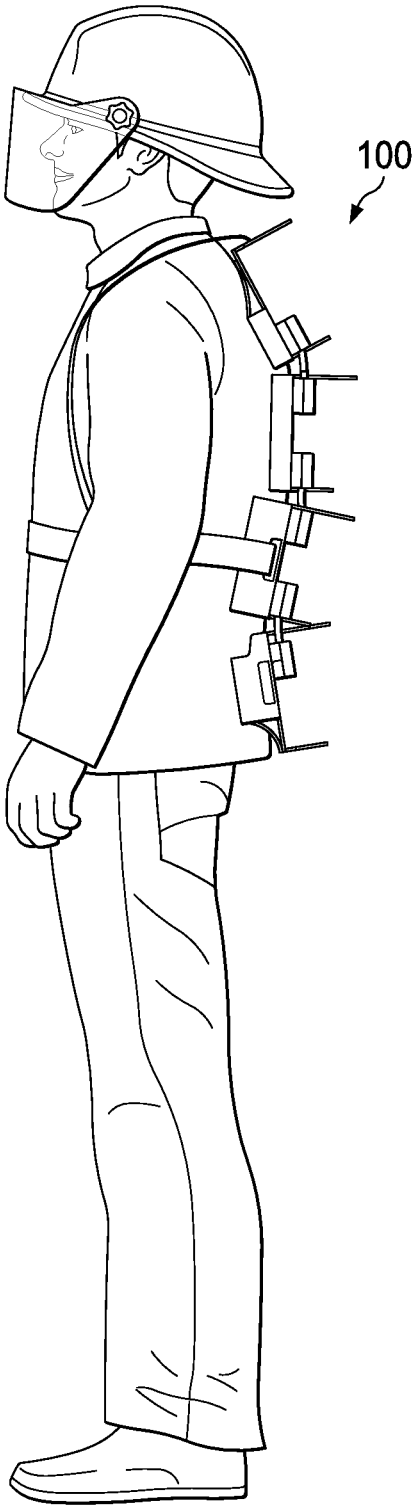
Figure 9:
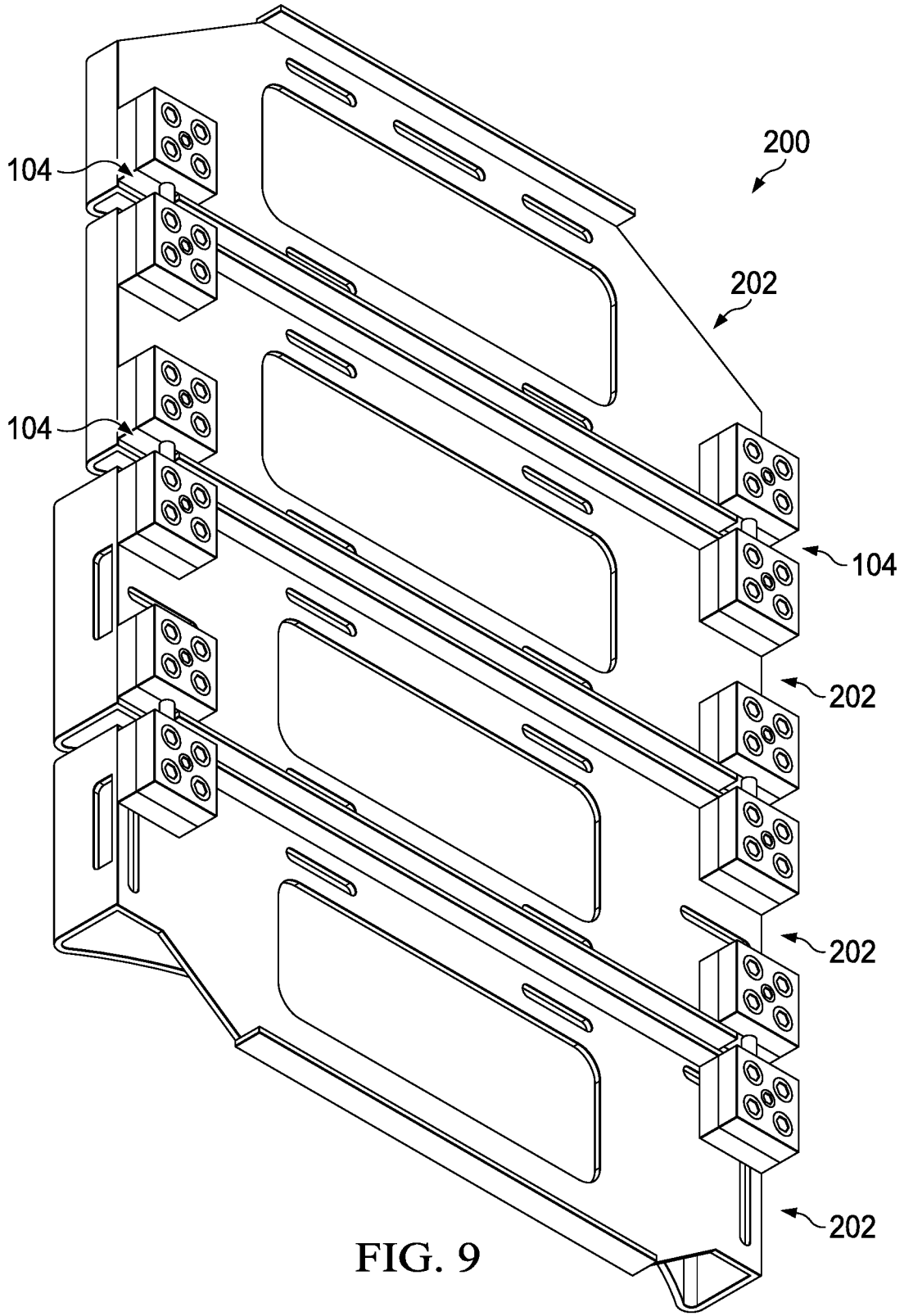

The figures described are for illustration purposes only and are not intended to limit the scope of the present disclosure in any way. Various aspects of the present invention may be more fully understood from the detailed description and the accompanying drawing figures, wherein:

FIG. 1 is a side view representatively illustrating a human body with the spine and the orientation of a portion of an SCBA frame thereon in accordance with exemplary embodiments of the present technology;

FIG. 2 is a side view representatively illustrating the SCBA frame and harness on a user in accordance with exemplary embodiments of the present technology;

FIG. 3 is a rear view representatively illustrating the SCBA frame, harness, and air cylinders on a user in accordance with exemplary embodiments of the present technology;

FIG. 4 is a rear perspective view representatively illustrating a SCBA frame and harness in accordance with exemplary embodiments of the present technology;

FIG. 5A is a rear perspective view representatively illustrating the SCBA frame in accordance with exemplary embodiments of the present technology;

FIG. 5B is a front perspective view representatively illustrating the SCBA frame in accordance with exemplary embodiments of the present technology FIG. 6A is a rear view representatively illustrating the SCBA frame in accordance with exemplary embodiments of the present technology;

FIG. 6B is a side view representatively illustrating the SCBA frame in accordance with exemplary embodiments of the present technology FIG. 7A is a rear view of a top mounting plate for the SCBA frame in accordance with exemplary embodiments of the present technology;

FIG. 7B is a bottom view of the top mounting plate of FIG. 7A and an upper intermediate mounting plate for the SCBA frame in accordance with exemplary embodiments of the present technology;

FIG. 7C is a rear view of a lower mounting plate for the SCBA frame in accordance with exemplary embodiments of the present technology;

FIG. 7D is a bottom view of the lower mounting plate of FIG. 7C and a lower intermediate mounting plate for the SCBA frame in accordance with exemplary embodiments of the present technology;

FIG. 7E is a rear view of the intermediate mounting plate for the SCBA frame in accordance with exemplary embodiments of the present technology;

FIG. 7F is an end view of an intermediate mounting plate of FIG. 7E for the SCBA frame in accordance with exemplary embodiments of the present technology;

FIG. 8A is a side view representatively illustrating the SCBA frame and harness on a user where the user is kneeling in accordance with exemplary embodiments of the present technology;

FIG. 8B is a side view representatively illustrating the SCBA frame and harness on a user where the user is bent over in accordance with exemplary embodiments of the present technology;

FIG. 8C is a side view representatively illustrating the SCBA frame and harness on a user where the user is standing up in accordance with exemplary embodiments of the present technology; and FIG. 9 is an alternate embodiment of a in accordance with exemplary embodiments of the present technology.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may be used with a frame for SCBA product. The present technology may also be implemented with any suitable frame, which carries a load and is supported and/or worn by a user. In addition, the present technology may be practiced in conjunction with any number of materials and methods of manufacture and the system described is merely one exemplary application for the technology.

While exemplary embodiments are described herein in sufficient detail to enable those skilled in the art to practice the invention, it should be understood that other embodiments may be realized and that logical structural, material, and mechanical changes may be made without departing from the spirit and scope of the invention. This disclosure, its aspects and implementations, are not limited to the specific components or assembly procedures disclosed herein. Many additional components and assembly procedures known in the art consistent with the intended apparatus will become apparent for use with implementations of a SCBA frame and accompanying parts. Thus, the following descriptions are not intended as a limitation on the use or applicability of the invention, but instead, are provided merely to enable a full and complete description of exemplary embodiments.

Presently conventional SCBA apparatus including harnesses and bottles in the fire service consist of a rigid frame with a large generally vertically oriented air bottle that fits parallel to the spine, which splints the spine and hinders movement. As shown in FIG. 1, the spine of a user is not oriented generally vertical, rather it curves. Briefly, in accordance with exemplary embodiments, an outline of a SCBA frame is illustrated, which conforms to the orientation of the spine and allows for a more comfortable fit by a user.

As such, in various embodiments and shown in the FIG. 2, the present technology utilizes a SCBA frame 100 that may conform to the shape of the wearer's spine.

The SCBA frame 100 may maintain all National Institute for Occupational Safety and Health (NIOSH) standards with any of the cylinders listed as being provided by the SCBA manufacturer. The SCBA frame 100 may be approved to NIOSH 42 CFR, Part 84 for chemical, biological, radiological and nuclear protection (CBRN) with 30-, 45-, 60-minute-rated service life. The SCBA frame 100 may be compliant with all requirements of the National Fire Protection Association (NFPA) NFPA-1981, 2013 Edition "Standard on Open-Circuit Self-Contained Breathing Apparatus for Emergency Service".

The SCBA frame 100 may be compliant with all requirements of the NFPA-1982, 2013 Edition "Standard on Personal Alert Safety Systems", in that it will provide mounting points to be attached to the frame per individual manufactures.

The SCBA frame 100 may be compliant with the additional NFPA requirements and standards in scope and material utilized in the industry as prescribed in NFPA1981, NFPA 1986, NFPA 1500, NFPA 1852. The materials that may be utilized for the frame fabrication may include but are not limited to, various metal and steel alloys as well as hardened molded Plastic composites that meet the above requirements and are presently utilized in the industry for SCBAs in Fire Service. The specific composite material utilized can be dependent on the specific manufactures' proprietary material utilized.

The SCBA frame 100 may be compatible with standard harness assemblies, which incorporate parachute-type, quick release buckles, and include shoulder and hip pads that are consistent with the industry standards and may be manufactured with Kevlar®.

In one embodiment, shown in FIGS. 2 and 3, the SCBA frame 100 may comprise mounting plates 102 that are coupled by attachment mechanisms 104. FIG. 2 shows the SCBA frame 100 attached to a user by a conventional harness 106, which utilizes shoulder straps 108 and a waist belt 110, and further comprises air cylinder brackets 112 coupled to the mounting plates 102. FIG. 3 shows the SCBA frame 100 with the conventional harness 106, and the air cylinder brackets 112 that are configured to receive air cylinders 114.

The SCBA industry already has smaller bottles 10 and 15-minute sizes that will each fit onto the mounting plates 102 and can be connected together by the current high-pressure hoses also utilized in the industry. The SCBA frame 100 may be designed to carry four cylinders 114, valve assemblies, pressure reducing regulator assemblies, attachments for the industry standard Kevlar shoulder 108 and waist straps or belt 110. The SCBA frame 100 may also include and have additional points for mounting different manufacture's specific attachments and accessories, as will be discussed below. It should be understood that while a 4 piece SCBA frame is described above, other configurations with more or less mounting plates. The SCBA frame has many industrial applications, such as, mining or any other use where a user may need a pack or item to carry material.

Referring now to FIGS. 2-3, in various embodiments, the SCBA frame 100 may comprise multiple generally rectangular mounting plates 102 that are coupled by attachment mechanisms 104. In one embodiment, the SCBA frame 100 comprises four generally rectangular mounting plates 102 that are coupled by attachment mechanisms 104. The attachment mechanism 104 allows the mounting plates 102 to move relative to one another and allows the SCBA frame 100 to conform to the shape of the user's back. The attachment mechanism 104 may allow the user to move along vertically, horizontally, and torsionally.

The mounting plates 102 will each be positioned to run horizontal and perpendicular to the spine and lay across the back from left to right. These mounting plates 102 are distinct and separate and couple together via the attachment mechanisms 104. As shown in FIG. 3, the air cylinders 114 may then be attached to the SCBA frame 100 by an air cylinder bracket 112 or as otherwise described below.

As shown in FIG. 6A, in various embodiments the mounting plates 102 may comprise an upper mounting plate 116, an upper intermediate mounting plate 118, a lower intermediate mounting plate 120, and a lower mounting plate 122.

Referring now to FIGS. 6A and 7A, the upper mounting plate may 116 comprise an upper edge 124 and a lower edge 126. Each of the upper and lower edges 124, 126 may comprise a pair of slots 128. The slots 128 may be used to connect various SCBA components. For example, the slots 128 on the upper edge 124 of the upper mounting plate may be used to connect the shoulder straps 108. The upper mounting plate 116 may further comprise a central slot 130 that may also be used to connect the shoulder straps 108.

Referring now to FIG. 6A, the upper intermediate mounting plate 118 may comprise an upper edge 132 and a lower edge 134. Each of the upper and lower edges 132, 134 may comprise a pair of slots 136. The slots 136 may be used to connect various SCBA components.

Referring now to FIGS. 6A and 7E, the lower intermediate mounting plate 120 may comprise an upper edge 138 and a lower edge 140. Each of the upper and lower edges 138, 140 may comprise a pair of slots 142. The lower intermediate mounting plate may also comprise a pair of side slots 144 located proximate the sides of the lower intermediate mounting plate 120. The slots 142 may be used to connect various SCBA components. For example the side slots 144 may be used to connect the waist straps or belt 110.

Referring now to FIGS. 6A and 7C, the lower mounting plate 122 may comprise an upper edge 146 and a lower edge 148. Each of the upper and lower edges 146, 148 may comprise a pair of slots 150. The lower intermediate mounting plate may also comprise a pair of side slots 152 located proximate the sides of the lower mounting plate 122. The slots 150 may be used to connect various SCBA components. The slots 152 may be used to connect various SCBA components.

In various embodiments, the mounting plates 102 may comprise a plate with a removed center area 154. In one embodiment, the center area 154 may be machined or punched out during manufacturing. The center area may be removed to reduce the weight of the SCBA frame 100.

In various embodiments, and as shown in FIG. 7A, the upper corners of the upper mounting plate 116 may be removed to provide a slanted edged 156 from the sides of the upper mounting plate 116 to the upper edge 124 of the upper mounting plate 116.

In various embodiments, and as shown in FIG. 7C, the lower corners of the lower mounting plate 122 may be removed to provide a slanted edged 158 from the sides of the lower mounting plate 122 to the lower edge 148 of the lower mounting plate 122.

In various embodiments, and referring to FIGS. 5B, 7B, and 7D the mounting plates 102 may comprise additional back supports. The back supports are configured to support the contour of the user's back laterally outwardly from the spine. The back supports may be welded to the mounting plates 102 or may be constructed integrally with the mounting plates 102 and bent in place during manufacture.

The upper mounting plate 116 may comprise upper outer back supports 160. The upper intermediate mounting plate 118 may comprise upper intermediate back supports 162. The lower intermediate mounting plate 120 may comprise lower intermediate outer back supports 165. The lower mounting plate 122 may comprise lower outer back supports 167.

FIG. 7B shows the bottom view of the upper mounting plate 116 and the upper intermediate mounting plate 118. The back supports 160 and 162 are located outwardly from the vertical centerline proximate the ends of the plates 116, 118 and depend inwardly therefrom. The back supports 160, 162 may comprise an outer wall 164 and an inner wall 166. The outer wall 164 depends outwardly from the ends of the plates 116, 118 and the inner wall 166 depends from the outer wall 164 inwardly to a front surface 168. The inner wall 166 may be curved or straight. The 164 may include a vertical slot 169, which may be utilize to attach the belt 110 or any other suitable SCBA or firefighting component.

FIG. 7D shows the bottom view of the lower mounting plate 122 and the lower intermediate mounting plate 124. The back supports 165 and 167 are located outwardly from the vertical centerline proximate the ends of the plates 120, 122 and depend inwardly therefrom. The back supports may comprise an outer wall 170 and an inner wall 172. The outer wall 170 depends outwardly from the ends of the plates 120, 122 and the inner wall 172 depends from the outer wall 170 inwardly to a front surface 174.

The attachment mechanism 104 allows the mounting plates 102 to move relative to one another and allows the SCBA frame 100 to conform to the shape of the user's back. In various embodiments the attachment mechanisms may comprise cables, hinges, flanges or any other suitable fastening mechanism that allows the mounting plates 102 to move relative to one another to follow the contour of the user's back/spine while moving. The mounting plates 102 can be attached to one another by a single attachment mechanism 104 or multiple attachment mechanisms 104.

In various embodiments, the attachment mechanism 104 may comprise a cable 176 affixed to the mounting plates 102 by any suitable method. The cable may comprise an industrial aircraft grade material. The cables 176 may connect the mounting plates 102 such that the mounting plates 102 are configured to move and conform to the user's spine/back while in use.

In various embodiments, shown in FIGS. 5A and 6A, the attachment mechanism 104 may connect the upper mounting plate 116 to the upper intermediate mounting plate 118, the upper intermediate mounting plate 118 to the lower intermediate mounting plate 120, and the lower intermediate mounting plate 120 to the lower mounting plate 122.

In one embodiment the attachment mechanism 104 may comprise a mounting block 178 and the cable 176. The mounting block 178 may be welded or otherwise attached to the mounting plates 102 and oriented as shown in FIGS. 5A and 5B. The cable 176 may be attached to the mounting block 178 by any known method.

In one embodiment, and referring to FIGS. 5A, 6B, 7B, and 7D the mounting block 178 may comprise and inner portion 180 and an outer portion 182. One or both of the inner portion or outer portion may comprise a groove(s) 184 configured to receive the cables. The inner portion may be welded or otherwise affixed to the mounting plates 102. The inner portion 180 may comprise threaded holes (not shown that may receive bolts 185 placed within holes located in the outer portion 182. While a 4 bolt pattern is shown any suitable fastening method may be used. In one embodiment, the attachment mechanism may comprise a center screw 186, which may be used to further attach the cable 176.

In one embodiment, the groove 184 may comprise a circumference of ⅛ inch deep and extend through the mounting block 178. In one embodiment, an industrial 3/16 aircraft grade metal cable is received within the groove 184 and the outer portion 182 is tightened onto the inner portion 180. Once the outer portion 182 is tightened onto the inner portion 180 the center screw 186 may utilized to further clamp the cable.

In various embodiment, and referring to FIGS. 4 and 5A, the SCBA frame 100 may comprise an air cylinder attachment system 186 used to attach air cylinders 114. The air cylinder attachment system 186 may comprise an upper flange 188 and a lower flange 190. The upper flanges 188 depends outwardly from the upper edge of the mounting plates 102 and the lower flanges 190 depends outwardly from the lower edges of the mounting plates 102. Each of the upper flanges 188 may comprise a central cutout 192. Each of the lower flanges 190 may comprise a cutout 194 and/or at least one slot 196. The central cutout 192 and the slots 194 are configured to allow for various straps 198 or other type of connectors to be used to attach the air cylinders, as shown in FIGS. 3 and 4.

Future developments in technology may present an opportunity for improvements in the design of the frame 100. The SCBA bottle utilized for this design was a 3000-psi bottle with overall dimensions of 4⅜ inches in diameter and 16 inches long including the knob and gauge. The actual bottle was 13 inches long. The number of mounting plates 102 as presented is 4 plates for the SCBA frame 100 and also 4 plates for the other applications noted. The overall dimensions of the entire frame as well as the size and number of mounting plates 102 may also change. There may be as few as 3 mounting plates 102 and as many that can fit along the length of the pack, as the width of each plate may be manufactured narrower in the future. The key is that the SCBA frame 100 facilitates increased movement of the spine by that off additional points of movement over the present rigid frame designs that are currently utilized. The SCBA frame 100 design allows for the points of movement by that of the cable system attachment mechanism 104. Hinges, Ball joints, springs, and any other material that will form a joint are contemplated and may be suitable for use. The cable system/attachment mechanism 104 allows for a move versatile joint that allows 360 degrees of movement and is of heavy enough gauge material to support axial loading of the pack and allows some "give" in not only the vertical axial loading but also lateral axial stresses. The cable system/attachment mechanism 104 may be centrally located or located at the ends of the mounting plates 102. As shown in FIGS. 8A-8C, the user is allowed much more freedom of movement utilizing the SCBA frame 100 design. The SCBA frame 100 design moves with the user's back rather than being limited.

Although SCBA frame 100 design was initiated with respect to firefighting equipment it should be understood that this SCBA frame 100 design may benefit other people outside the Fire Service. As shown in FIG. 9, a mobility frame 200 may comprise any type of back frame utilized for hiking, hunting, back packing or even military operations can be improved with this concept of the Advance Spinal Mobility Frame. With some minor modifications, this mobility frame 200 design is fully applicable for a Back-Pack application.

The mobility frame 200 may comprise multiple generally rectangular mounting plates 202 that are coupled by attachment mechanisms 104. In one embodiment, the mobility frame 200 comprises four generally rectangular mounting plates 202 that are coupled by attachment mechanisms 104. The attachment mechanism 104 allows the mounting plates 202 to move relative to one another and allows the SCBA frame 100 to conform to the shape of the user's back. The attachment mechanism 104 may allow the user to move along vertically, horizontally, and torsionally.

The mounting plates 202 are similar to mounting plates 102 of but the SCBA air cylinder attachment system 186 have been removed. The mount plates 202 allow points (slot, cutouts, etc.) for securing the material and webbing that makes up the various back packs in the industry and it's done. The cable system/attachment mechanism 104 may be centrally located or located at the ends of the individual mounting plates 202. The orientation of the cable system/attachment mechanism 104 and the mounting plates 202 would be the same regardless of whether the mobility frame 200 does or does not include the SCBA air cylinder attachment system 186.

The width of the mobility frame 200 can be reduced to whatever the need of the pack manufacturing company may require. Many frames of the traditional one-piece vertical back pack frames are approximately 8 inches by 26 inches. The cable system/attachment mechanism 104, slots and punch outs along with the lumbar attachments will not change.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to a preferred embodiment. However, changes and modifications may be made to the preferred embodiment without departing from the scope of the present technology. These and other changes or modifications are intended to be included within the scope of the present technology, as expressed in the following claims.

The invention claimed is:

1. A frame for mounting at least one self-contained breathing apparatus bottle such that the frame can articulate with the back of a user, the frame comprising:

an upper plate comprising a top edge, a bottom edge, and a pair of sides;

an intermediate plate comprising a top edge, a bottom edge, and a pair of sides;

a lower plate comprising a top edge, a bottom edge, and, a pair of sides;

a first attachment mechanism pivotally coupling the bottom edge of the upper plate to the top edge of the intermediate plate; and a second attachment mechanism pivotally coupling to the bottom edge of the intermediate plate and the top edge of the lower plate, wherein the first and second attachment mechanisms each comprise a pair of attachment mechanisms located proximate the sides of the upper plate, the intermediate plate, and the lower plate, and wherein the first and second attachment mechanisms allow the upper plate, intermediate plate, and lower plate to articulate about a horizontal axis and torsionally in line with the user's movement; and wherein a void space exists between, fully separates, and extends along a width of the bottom edge of the upper plate and the top edge of the intermediate plate, and the bottom edge of the intermediate plate and the top edge of the lower plate.

2. The frame of claim 1, wherein a void space exists between each pair of attachment mechanisms.

3. The frame of claim 1, wherein the first and second attachment mechanisms comprise cables.

4. The frame of claim 3, wherein the first and second attachment mechanisms each further comprise a pair of blocks coupled to and located proximate the sides of the upper plate, intermediate plate, and lower plate.

5. The frame of claim 4, wherein the cables are coupled to the pair of blocks.

6. The frame of claim 5, wherein the cables are coupled within a groove in at least one of the blocks.

7. The frame of claim 1, wherein the upper plate, the intermediate plate, and the lower plate each comprise a pair of lumbar supports coupled to an inner surface of the plates and depending inwardly from the sides of the plates.

8. The frame of claim 1, wherein the upper plate, the intermediate plate, and the lower plate are substantially rectangular.

9. The frame of claim 1, further comprising an air cylinder attachment system, comprising:

an upper flange depending outwardly from each of the upper edge of the upper plate, the intermediate plate, and the lower plate; and a lower flange depending outwardly from each of the lower edge of the upper plate, the intermediate plate, and the lower plate.

10. The frame of claim 9, wherein each of the upper flange and the lower flange comprise a cutout configured to receive a strap to attach the at least one self-contained breathing apparatus bottle between the upper flange and the lower flange of the upper plate, the intermediate plate, and the lower plate.

11. The frame of claim 1, wherein the intermediate plate comprises:

an upper intermediate plate comprising a top edge, a bottom edge, and a pair of sides;

a lower intermediate plate comprising a top edge, a bottom edge, and, a pair of sides; and a third attachment mechanism pivotally coupling the bottom edge of the upper intermediate plate to the top edge of the lower intermediate plate.

12. A frame for mounting at least one self-contained breathing apparatus bottle such that the frame can move with the back of a user, the frame comprising:

an upper plate comprising a top edge, a bottom edge, and a pair of sides;

an upper intermediate plate comprising a top edge, a bottom edge, and a pair of sides;

a lower intermediate plate comprising a top edge, a bottom edge, and, a pair of sides;

a lower plate comprising a top edge, a bottom edge, and, a pair of sides;

a first attachment mechanism pivotally coupling the bottom edge of the upper plate and the top edge of the upper intermediate plate;

a second attachment mechanism pivotally coupling the bottom edge of the upper intermediate plate to the top edge of the lower intermediate plate; and a third attachment mechanism pivotally coupling the bottom edge of the lower intermediate plate to a top edge of the lower plate, wherein the first, second, and third attachment mechanisms each comprise a pair of attachment mechanisms located proximate the sides of the upper plate, the upper intermediate plate, the lower intermediate plate, and the lower plate, and wherein the first, second, and third attachment mechanisms allow the upper plate, the upper intermediate plate, the lower intermediate plate, and the lower plate to articulate about a horizontal axis and torsionally in line with the user's movement, and wherein a void space exists between, fully separates, and extends along a width of:

the bottom edge of the upper plate and the top edge of the upper intermediate plate, the bottom edge of the upper intermediate plate and the top edge of the lower intermediate plate, the bottom edge of the lower intermediate plate and the top edge of the lower plate.

13. The frame of claim 12, wherein each pair of first, second, and third attachment mechanisms each comprise:

a pair of blocks coupled to and located proximate the sides of the upper plate, the upper intermediate plate, the lower intermediate plate, and the lower plate;

a pair of cables coupled to the pair of blocks.

14. The frame of claim 13, wherein the cables are coupled within a groove in at least one of the blocks.

15. An articulating frame for a back pack system such that the frame can move with the back of a user, the articulating frame comprising:

an upper plate comprising a top edge, a bottom edge, and a pair of sides;

an intermediate plate comprising a top edge, a bottom edge, and a pair of sides;

a lower plate comprising a top edge, a bottom edge, and, a pair of sides;

a first attachment mechanism pivotally coupling the bottom edge of the upper plate to the top edge of the intermediate plate; and a second attachment mechanism pivotally coupling the bottom edge of the intermediate plate to the top edge of the lower plate, wherein the first and second attachment mechanisms each comprise a pair of attachment mechanisms located proximate the sides of the upper plate, the intermediate plate, and the lower plate, and wherein the first and second attachment mechanisms allow the upper plate, intermediate plate, and lower plate to articulate about a horizontal axis and torsionally in line with the user's movement; and wherein a void space exists between, fully separates, and extends along a width of the bottom edge of the upper plate and the top edge of the intermediate plate, and the bottom edge of the intermediate plate and the top edge of the lower plate.

* * * * *